US012760393B1

(12) United States Patent
Visco et al.

(10) Patent No.: US 12,760,393 B1
(45) Date of Patent: Oct. 13, 2026

(54) METHODS AND APPARATUSES FOR LI EXTRACTION AND GENERATION OF HIGH PURITY LITHIUM HYDROXIDE

(71) Applicant: PolyPlus Battery Company, Berkeley, CA (US)

(72) Inventors: Steven J. Visco, Berkeley, CA (US); Yevgeniy S. Nimon, Berkeley, CA (US); Bruce D. Katz, Moraga, CA (US)

(73) Assignee: PolyPlus Battery Company, Berkeley, CA (US)

( * ) Notice: Subject to any disclaimer, the term of this patent is extended or adjusted under 35 U.S.C. 154(b) by 742 days.

(21) Appl. No.: 18/149,524

(22) Filed: Jan. 3, 2023

Related U.S. Application Data

(60) Provisional application No. 63/266,481, filed on Jan. 6, 2022.

(51) Int. Cl.

| | |
|---|---|
| ***C22B 26/12*** | (2006.01) |
| ***C25B 1/16*** | (2006.01) |
| ***C25B 9/19*** | (2021.01) |
| ***C25B 13/07*** | (2021.01) |

(52) U.S. Cl.
CPC ..... *C22B 26/12* (2013.01); *C25B 1/16* (2013.01); *C25B 9/19* (2021.01); *C25B 13/07* (2021.01)

(58) Field of Classification Search
None
See application file for complete search history.

(56) References Cited

U.S. PATENT DOCUMENTS

| | | | |
|---|---|---|---|
| 3,994,676 | A | 11/1976 | Strimple et al. |
| 4,037,043 | A | 7/1977 | Segsworth |
| 4,042,482 | A | 8/1977 | Shannon et al. |
| 4,090,054 | A | 5/1978 | Heine et al. |
| 4,121,985 | A | 10/1978 | Cherenko |
| 4,208,474 | A | 6/1980 | Jacobson et al. |
| 4,331,750 | A | 5/1982 | Malugani et al. |
| 4,444,857 | A | 4/1984 | Duchange et al. |
| 4,447,393 | A | 5/1984 | Weirauch |
| 4,465,745 | A | 8/1984 | Akridge |
| 4,465,746 | A | 8/1984 | Akridge |
| 4,477,545 | A | 10/1984 | Akridge et al. |
| 4,478,920 | A | 10/1984 | Gabano et al. |

(Continued)

FOREIGN PATENT DOCUMENTS

| | | | |
|---|---|---|---|
| BR | 112017011548 | A2 | 7/2018 |
| BR | 112017011768 | A2 | 7/2018 |

(Continued)

OTHER PUBLICATIONS

Akridge, James R. et al., "Solid state batteries using vitreous solid electrolytes," Solid State Ionics 18 & 19 (1986) 1082-1087.

(Continued)

*Primary Examiner* — Michael Forrest
(74) *Attorney, Agent, or Firm* — Weaver Austin Villeneuve & Sampson LLP

(57) ABSTRACT

Methods and apparatus for Li extraction involve a dry transfer electrolysis process for extracting, enriching, purifying and/or producing an aqueous Li substance as a primary product from a liquid Li input solution that is derived from a Li resource, such as a geothermal or oilfield brine.

20 Claims, 7 Drawing Sheets

(56) References Cited

U.S. PATENT DOCUMENTS 4,513,070 A 4/1985 Carette et al.
4,529,027 A 7/1985 Brice et al.
4,585,714 A 4/1986 Akridge
4,599,284 A 7/1986 Akridge
4,735,850 A 4/1988 Eitman
4,863,553 A 9/1989 Lehoczky et al.
4,863,798 A 9/1989 Arenz et al.
4,985,317 A 1/1991 Adachi et al.
5,246,782 A 9/1993 Kennedy et al.
5,314,765 A 5/1994 Bates
5,338,625 A 8/1994 Bates et al.
5,455,126 A 10/1995 Bates et al.
5,512,147 A 4/1996 Bates et al.
5,567,210 A 10/1996 Bates et al.
5,569,520 A 10/1996 Bates
5,582,623 A 12/1996 Chu
5,597,660 A 1/1997 Bates et al.
5,612,152 A 3/1997 Bates
5,648,187 A 7/1997 Skotheim
5,686,201 A 11/1997 Chu
5,702,995 A 12/1997 Fu
5,814,420 A 9/1998 Chu
5,824,434 A 10/1998 Kawakami et al.
5,958,281 A 9/1999 Takada et al.
5,961,672 A 10/1999 Skotheim et al.
6,030,909 A 2/2000 Fu
6,042,739 A 3/2000 Itoh
6,214,061 B1 4/2001 Visco et al.
6,315,881 B1 11/2001 Fu
6,402,795 B1 6/2002 Chu et al.
6,405,565 B1 6/2002 Aitken et al.
6,413,285 B1 7/2002 Chu et al.
6,432,584 B1 8/2002 Visco et al.
6,479,028 B1 11/2002 Kaner et al.
6,485,622 B1 11/2002 Fu
6,723,140 B2 4/2004 Chu et al.
6,733,924 B1 5/2004 Skotheim et al.
6,797,428 B1 9/2004 Skotheim et al.
7,211,532 B2 5/2007 Fu
7,247,408 B2 7/2007 Skotheim et al.
7,273,682 B2 9/2007 Park et al.
7,282,295 B2 10/2007 Visco et al.
7,282,296 B2 10/2007 Visco et al.
7,282,302 B2 10/2007 Visco et al.
7,390,591 B2 6/2008 Visco et al.
7,645,543 B2 1/2010 Visco et al.
7,666,233 B2 2/2010 Visco et al.
7,824,806 B2 11/2010 Visco et al.
7,829,212 B2 11/2010 Visco et al.
7,838,144 B2 11/2010 Visco et al.
7,858,223 B2 12/2010 Visco et al.
8,012,631 B2 9/2011 Seino et al.
8,048,570 B2 11/2011 Visco et al.
8,048,571 B2 11/2011 Visco et al.
8,088,697 B2 1/2012 Yuh et al.
8,092,941 B2 1/2012 Weppner et al.
8,114,171 B2 2/2012 Visco et al.
8,129,052 B2 3/2012 Visco et al.
8,182,943 B2 5/2012 Visco et al.
8,202,649 B2 6/2012 Visco et al.
8,293,398 B2 10/2012 Visco et al.
8,304,019 B1 11/2012 Pichler
8,304,115 B1 11/2012 Petkov et al.
8,323,820 B2 12/2012 Visco et al.
8,334,075 B2 12/2012 Visco et al.
8,389,147 B2 3/2013 Visco et al.
8,404,388 B2 3/2013 Visco et al.
8,445,136 B2 5/2013 Visco et al.
8,455,131 B2 6/2013 Visco et al.
8,501,339 B2 8/2013 Visco et al.
8,556,197 B2 10/2013 Hama et al.
8,652,686 B2 2/2014 Visco et al.
8,658,304 B2 2/2014 Visco et al.
8,658,317 B2 2/2014 Weppner et al.
8,673,477 B2 3/2014 Visco et al.
8,691,444 B2 4/2014 Visco et al.
8,691,928 B2 4/2014 Hsieh et al.
8,778,522 B2 7/2014 Visco et al.
8,778,543 B2 7/2014 Shinohara et al.
8,828,573 B2 9/2014 Visco et al.
8,828,574 B2 9/2014 Visco et al.
8,828,575 B2 9/2014 Visco et al.
8,828,580 B2 9/2014 Visco et al.
8,923,360 B2 12/2014 Coleman et al.
9,077,041 B2 7/2015 Burnside et al.
9,123,941 B2 9/2015 Visco et al.
9,130,198 B2 9/2015 Visco et al.
9,136,568 B2 9/2015 Visco et al.
9,287,573 B2 3/2016 Visco et al.
9,321,652 B2 4/2016 Paquette et al.
9,362,538 B2 6/2016 Visco et al.
9,379,368 B2 6/2016 Roumi
9,598,769 B2 3/2017 Elam et al.
9,601,779 B2 3/2017 Visco et al.
9,660,265 B2 5/2017 Visco et al.
9,905,860 B2 2/2018 Visco et al.
10,147,968 B2 12/2018 Visco et al.
10,164,289 B2 12/2018 Visco et al.
10,601,071 B2 3/2020 Visco et al.
10,629,950 B2 4/2020 Visco et al.
10,707,536 B2 7/2020 Visco et al.
10,804,111 B2 10/2020 Hashimoto et al.
10,833,361 B2 11/2020 Visco et al.
10,840,546 B2 11/2020 Visco et al.
10,840,547 B2 11/2020 Visco et al.
10,862,171 B2 12/2020 Visco et al.
10,868,293 B2 12/2020 Visco et al.
10,916,753 B2 2/2021 Visco et al.
11,171,364 B2 11/2021 Visco et al.
11,174,190 B2 11/2021 Valli et al.
11,239,495 B2 2/2022 Visco et al.
11,444,270 B2 9/2022 Visco et al.
11,631,889 B2 4/2023 Visco et al.
11,646,444 B2 5/2023 Visco et al.
11,646,445 B2 5/2023 Visco et al.
11,749,834 B2 9/2023 Visco et al.
11,817,569 B2 11/2023 Visco et al.
11,876,174 B2 1/2024 Visco et al.
11,984,553 B2 5/2024 Visco et al.
12,021,187 B2 6/2024 Visco et al.
12,021,238 B2 6/2024 Visco et al.
12,034,116 B2 7/2024 Visco et al.
12,051,824 B2 7/2024 Visco et al.
12,183,880 B2 12/2024 Visco et al.
12,237,511 B2 2/2025 Visco et al.
12,294,050 B2 5/2025 Visco et al.
12,294,051 B2 5/2025 Visco et al.
12,374,717 B2 7/2025 Visco et al.
12,454,478 B2 10/2025 Visco et al.
12,482,827 B2 11/2025 Visco et al.
12,482,857 B2 11/2025 Visco et al.
2002/0004173 A1 1/2002 Berkey et al.
2002/0012846 A1 1/2002 Skotheim et al.
2002/0036131 A1 3/2002 Kugai et al.
2002/0182508 A1 12/2002 Nimon et al.
2003/0099884 A1 5/2003 Chiang et al.
2003/0134734 A1 7/2003 Nishimoto et al.
2004/0005504 A1 1/2004 Kugai et al.
2004/0200519 A1 10/2004 Sterzel et al.
2005/0063652 A1 3/2005 Johnson et al.
2005/0107239 A1 5/2005 Akiba et al.
2006/0222954 A1 10/2006 Skotheim et al.
2007/0037058 A1 2/2007 Visco et al.
2007/0059533 A1 3/2007 Burdette et al.
2007/0087269 A1 4/2007 Inda
2007/0119212 A1 5/2007 Huang et al.
2007/0148533 A1 6/2007 Anglin et al.
2007/0160911 A1 7/2007 Senga et al.
2007/0207186 A1 9/2007 Scanlon et al.
2007/0231704 A1 10/2007 Inda
2007/0248888 A1 10/2007 Seino et al.
2007/0271957 A1 11/2007 Nakamura et al.
2007/0281089 A1 12/2007 Heller et al.
2007/0295385 A1 12/2007 Sheats et al.

(56) References Cited

U.S. PATENT DOCUMENTS

2008/0057386 A1 3/2008 Visco et al.
2008/0057399 A1 3/2008 Visco et al.
2008/0245671 A1* 10/2008 Balagopal ..... C01B 25/37 204/252
2008/0318132 A1 12/2008 Visco et al.
2009/0100874 A1 4/2009 Tateishi et al.
2009/0142669 A1 6/2009 Shinohara et al.
2009/0159839 A1 6/2009 Seino et al.
2009/0297935 A1 12/2009 Visco et al.
2010/0022378 A1 1/2010 Nguyen et al.
2010/0040952 A1 2/2010 Kimura et al.
2010/0075209 A1 3/2010 Kimura et al.
2010/0135706 A1 6/2010 Miki et al.
2010/0190063 A1 7/2010 Fukumoto et al.
2011/0065007 A1 3/2011 Kamiya et al.
2011/0076570 A1 3/2011 Hama et al.
2011/0108642 A1 5/2011 Hama et al.
2011/0117726 A1 5/2011 Pinnington et al.
2011/0269007 A1 11/2011 Visco et al.
2012/0034529 A1 2/2012 Tatsumisago et al.
2012/0058280 A1 3/2012 Chung et al.
2012/0077020 A1 3/2012 Muramatsu et al.
2012/0094188 A1 4/2012 Visco et al.
2012/0177997 A1 7/2012 Nakamoto et al.
2012/0183834 A1 7/2012 Kanda et al.
2012/0183880 A1 7/2012 Toussaint et al.
2012/0189918 A1 7/2012 Tatsumisago et al.
2012/0204601 A1 8/2012 Murakami
2012/0309157 A1 12/2012 Iwamatsu et al.
2012/0315482 A1 12/2012 Muramatsu et al.
2013/0146476 A1* 6/2013 Chon ..... C22B 26/12 205/770
2013/0164631 A1 6/2013 Ohtomo et al.
2013/0164632 A1 6/2013 Kato et al.
2013/0288134 A1 10/2013 Hama et al.
2013/0340827 A1 12/2013 Watzke et al.
2014/0072875 A1 3/2014 Uchiyama
2014/0084224 A1 3/2014 Rittmeyer et al.
2014/0090421 A1 4/2014 Shock et al.
2014/0093785 A1 4/2014 Sugiura et al.
2014/0141341 A1 5/2014 Ohtomo et al.
2014/0151371 A1 6/2014 Chang et al.
2014/0154586 A1 6/2014 Hayashi et al.
2014/0162108 A1 6/2014 Visco et al.
2014/0170465 A1 6/2014 Visco et al.
2014/0186785 A1 7/2014 Mellen
2014/0272524 A1 9/2014 Visco et al.
2014/0322584 A1 10/2014 Visco et al.
2014/0339194 A1 11/2014 Gu et al.
2015/0068251 A1 3/2015 Ottermann et al.
2015/0079481 A1 3/2015 Sun et al.
2015/0107510 A1 4/2015 Lindfors
2015/0138636 A1 5/2015 O'Reilly et al.
2015/0171431 A1 6/2015 Yamada et al.
2015/0214555 A1 7/2015 Visco et al.
2015/0291753 A1 10/2015 Tsukamura et al.
2015/0293347 A1 10/2015 Kreit et al.
2015/0340720 A1 11/2015 Visco et al.
2015/0344342 A1 12/2015 Nguyen et al.
2015/0349371 A1 12/2015 Neudecker et al.
2016/0028053 A1 1/2016 Visco et al.
2016/0028063 A1 1/2016 Visco et al.
2016/0072153 A1 3/2016 Ichikawa et al.
2016/0133989 A1 5/2016 Suzuki et al.
2016/0156065 A1 6/2016 Visco et al.
2016/0190640 A1 6/2016 Visco et al.
2016/0197326 A1 7/2016 Visco et al.
2016/0211547 A1 7/2016 Hwang et al.
2016/0218349 A1 7/2016 Hasegawa et al.
2016/0257593 A1 9/2016 Nguyen et al.
2016/0261002 A1 9/2016 Trevey et al.
2016/0351878 A1 12/2016 Visco et al.
2016/0351879 A1 12/2016 Visco et al.
2016/0351889 A1 12/2016 Swonger et al.
2017/0229731 A1 8/2017 Visco et al.
2017/0288228 A1 10/2017 Ito et al.
2017/0309899 A1 10/2017 Son et al.
2017/0331156 A1 11/2017 Visco et al.
2017/0355632 A1 12/2017 Mcenroe et al.
2017/0365853 A1 12/2017 Visco et al.
2018/0131040 A1 5/2018 Visco et al.
2018/0201540 A1 7/2018 Sheen et al.
2018/0269527 A1 9/2018 Minami
2018/0309157 A1 10/2018 Visco et al.
2018/0309166 A1 10/2018 Yersak et al.
2019/0013546 A1 1/2019 Visco et al.
2019/0148768 A1 5/2019 Visco et al.
2019/0173128 A1 6/2019 Visco et al.
2019/0177878 A1 6/2019 Kanatzidis et al.
2019/0181496 A1 6/2019 Visco et al.
2019/0194052 A1 6/2019 Nguyen et al.
2019/0229370 A1 7/2019 Visco et al.
2019/0237801 A1 8/2019 Kanno et al.
2019/0237810 A1 8/2019 Visco et al.
2019/0241455 A1 8/2019 Sweney et al.
2019/0276356 A1 9/2019 Abbott et al.
2019/0305370 A1 10/2019 Minamida
2019/0321921 A1 10/2019 Paris et al.
2020/0014063 A1 1/2020 Visco et al.
2020/0028209 A1 1/2020 Visco et al.
2020/0123038 A1 4/2020 Jud et al.
2020/0127275 A1 4/2020 Visco et al.
2020/0243902 A1 7/2020 Visco et al.
2020/0251773 A1 8/2020 Visco et al.
2020/0259212 A1 8/2020 Visco et al.
2020/0287232 A1 9/2020 Mukherjee et al.
2020/0395633 A1 12/2020 Visco et al.
2021/0079496 A1* 3/2021 Harris ..... C22B 26/12
2021/0098818 A1 4/2021 Visco et al.
2021/0098819 A1 4/2021 Visco et al.
2021/0111427 A1 4/2021 Visco et al.
2021/0126236 A1 4/2021 Visco et al.
2021/0218005 A1 7/2021 Matzner et al.
2021/0218055 A1 7/2021 Visco et al.
2021/0320328 A1 10/2021 Visco et al.
2021/0340048 A1 11/2021 Visco et al.
2021/0380456 A1 12/2021 Visco et al.
2021/0381115 A1 12/2021 Kang et al.
2021/0395128 A1 12/2021 Visco et al.
2022/0013857 A1 1/2022 Visco et al.
2022/0042182 A1* 2/2022 Dara ..... C01D 15/02
2022/0045328 A1 2/2022 Visco et al.
2022/0045352 A1 2/2022 Visco et al.
2022/0045353 A1 2/2022 Visco et al.
2022/0216509 A1 7/2022 Sasaki et al.
2022/0263137 A1 8/2022 Visco et al.
2022/0302492 A1 9/2022 Visco et al.
2022/0320573 A1 10/2022 Visco et al.
2022/0320579 A1 10/2022 Visco et al.
2022/0328865 A1 10/2022 Visco et al.
2022/0328866 A1 10/2022 Visco et al.
2022/0336849 A1 10/2022 Visco et al.
2022/0396516 A1 12/2022 Visco et al.
2022/0399567 A1 12/2022 Visco et al.
2023/0091921 A1 3/2023 Visco et al.
2023/0098257 A1 3/2023 Visco et al.
2023/0299336 A1 9/2023 Visco et al.
2023/0335786 A1 10/2023 Visco et al.
2023/0335789 A1 10/2023 Visco et al.
2023/0420634 A1 12/2023 Visco et al.
2024/0088359 A1 3/2024 Visco et al.
2024/0088433 A1 3/2024 Visco et al.
2024/0092676 A1 3/2024 Visco et al.
2024/0283011 A1 8/2024 Visco et al.
2024/0347731 A1 10/2024 Visco et al.
2024/0347763 A1 10/2024 Visco et al.
2024/0347764 A1 10/2024 Visco et al.
2024/0363895 A1 10/2024 Visco et al.
2024/0405263 A1 12/2024 Visco et al.
2025/0006984 A1 1/2025 Visco et al.
2025/0174665 A1 5/2025 Visco et al.

(56) References Cited

U.S. PATENT DOCUMENTS

| | | | |
|---|---|---|---|
| 2025/0219084 | A1 | 7/2025 | Visco et al. |
| 2025/0372700 | A1 | 12/2025 | Visco et al. |

FOREIGN PATENT DOCUMENTS

| | | | | |
|---|---|---|---|---|
| CN | 101346424 | A | 1/2009 | |
| CN | 101494299 | A | 7/2009 | |
| CN | 101535039 | A | 9/2009 | |
| CN | 102197157 | A | 9/2011 | |
| EP | 0774654 | B1 | 1/2000 | |
| EP | 3227952 | A1 | 10/2017 | |
| JP | 2004063419 | A | 2/2004 | |
| JP | 2004127743 | A | 4/2004 | |
| JP | 2007311084 | A | 11/2007 | |
| JP | 2008103229 | A | 5/2008 | |
| JP | 2008103258 | A | 5/2008 | |
| JP | 2008300300 | A | 12/2008 | |
| JP | 2009158476 | A | 7/2009 | |
| JP | 2009252670 | A | 10/2009 | |
| JP | 2010108881 | A | 5/2010 | |
| JP | 2010123463 | A | 6/2010 | |
| JP | 2012043654 | A | 3/2012 | |
| JP | 2012089244 | A | 5/2012 | |
| JP | 2012089424 | A | 5/2012 | |
| JP | 2012096973 | A | 5/2012 | |
| JP | 2013117398 | A | 6/2013 | |
| JP | 2013232335 | A | 11/2013 | |
| JP | 2014035989 | A | 2/2014 | |
| JP | 2014096311 | A | 5/2014 | |
| JP | 2014127272 | A | 7/2014 | |
| JP | 2014221714 | A | 11/2014 | |
| KR | 20140011258 | A | 1/2014 | |
| WO | WO-9801401 | A1 | 1/1998 | |
| WO | WO-2009003695 | A2 | 1/2009 | |
| WO | WO-2009094524 | A1 | 7/2009 | |
| WO | WO-2012017544 | A1 | 2/2012 | |
| WO | WO-2013141481 | A1 | 9/2013 | |
| WO | WO-2016089897 | A1 | 6/2016 | |
| WO | WO-2016089899 | A1 | 6/2016 | |
| WO | WO-2016119003 | A1 * | 8/2016 | ..... C22B 3/44 |
| WO | WO-2017112550 | A1 | 6/2017 | |
| WO | WO-2017197039 | A1 | 11/2017 | |
| WO | WO-2018141919 | A1 | 8/2018 | |
| WO | WO-2019010047 | A1 | 1/2019 | |
| WO | WO-2019018386 | A1 | 1/2019 | |
| WO | WO-2019121340 | A1 | 6/2019 | |
| WO | WO-2019204244 | A1 | 10/2019 | |

OTHER PUBLICATIONS

Bartholomew, Roger F. et al., "Electrical properties of new glasses based on the Li2S—SiS2 system," Journal of Non-Crystalline Solids 256&257 (1999) 242-247.

Bates, J.B. et al., "Electrical properties of amorphous lithium electrolyte thin films," 1992, Solid State Ionics.

Bates, J.B. et al., "Thin-film rechargeable lithium batteries," 1995, Journal of Power Sources.

Bertschler, Eva-Maria et al., "Li+ Ion Conductors with Adamantane-Type Nitridophosphate Anions β-Li10P4N10 and Li13P4N10X3 with X=Cl, Br", Chemistry: A European Journal, vol. 24, Issue 1, (Jan. 2, 2018), pp. 196-205.

BR Office Action dated Mar. 28, 2022 in Application No. BR20171111548 with English translation.

BR Office Action dated Mar. 28, 2022 in Application No. BR20171111768 with English translation.

Burckhardt, W. et al., "Fast Li+ ion transport in iodine-thioborate glasses," Mat. Res. Bull., vol. 19, pp. 1083-1089, 1984.

CA Office Action dated May 31, 2022, in Application No. CA2969113.

CA Office Action dated Oct. 7, 2021, in application No. CA2,969,117.

Cao, C. et al., "Recent advances in inorganic solid electrolytes for lithium batteries," Frontiers in Energy Research, Jun. 27, 2014, vol. 2, No. 25, pp. 1-10.

Communication Pursuant to Article 94(3) EPC, First Office Action, dated May 13, 2019, for European Patent Application No. 15864779.2.

Communication Pursuant to Rules 161(2) and 162 EPC, (request for extra claims fees), dated Aug. 4, 2017, for European Patent Application No. 15864779.2.

Communication Pursuant to Rules 70(2) and 70a(2), dated Jun. 8, 2018, deadline for response to Extended European Search Report, for European Patent Application No. 15864779.2.

Decision for Grant, dated Sep. 29, 2020, for Japanese Patent Application No. 2017-529785, with translation.

EP Search Report dated Dec. 22, 2021, in Application No. EP21183687.9.

Examination Report, dated Sep. 14, 2020, for European Patent Application No. 15864779.2, 3 Pages.

Extended European Search Report, dated May 22, 2018, for European Patent Application No. 15864779.2.

Final Office Action for U.S. Appl. No. 15/726,302, dated Dec. 30, 2020.

Final Office Action for U.S. Appl. No. 15/929,959, dated Apr. 29, 2021.

First Office Action, dated Dec. 15, 2020, for Canadian Patent Application No. 2,969,113.

First Office Action, dated Feb. 3, 2019, for Chinese Patent Application No. 201580075233.0, with Chinese Search Report and English Translation.

First Office Action, dated Jan. 14, 2020, for Brazilian Patent Application No. BR112017011548-4, with English Translation.

First Office Action, dated Jan. 14, 2020, for Brazilian Patent Application No. BR112017011768-1, with English Translation.

First Office Action, dated May 10, 2021, for Canadian Patent Application No. 2,969,117.

Fu, Jie, "Fast Li+ ion conducting glass-ceramics in the system Li2O—A12O3—GeO2—P2O5" Solid State Ionics 104 (1997), pp. 191-194.

Fu, Jie, "Fast Li+ Ion Conduction in Li2O—Al2O3—TiO2—SiO2—P2O5 Glass-Ceramics," Journal of the American Ceramics Society, vol. 80, No. 7, Jul. 1997, pp. 1-5.

Fu, Jie, "Superionic conductivity of glass-ceramics in the system Li2O—Al2O3—TiO3—P2O5", Solid State Ionics 96 (1997), pp. 195-200.

Geiss, M. "Sacrificial Interlayers for All-solid-state Batteries", Aug. 14, 2020, pp. 243.

George, S.M., "Atomic layer deposition: an overview", Chemical reviews, (Jan. 13, 2010), 110(1):111-31.

Hayashi, A. et al., "Preparation of $Li_2S$—$P_2S_5$ Amorphous Solid Electrolytes by Mechanical Milling," Journal of American Ceramic Society, Feb. 28, 2001, vol. 84, No. 2, pp. 477-479.

Hayashi, Akitoshi et al., "Characterization of Li2S—P2S5 glass-ceramics as a solid electrolyte for lithium secondary batteries," Solid State Ionics 175 (2004) 683-686.

Hayashi, Akitoshi et al., "Formation of superionic crystals from mechanically milled Li2S—P2S5 glasses," Electrochemistry Communications 5 (2003) 111-114, Nov. 26, 2002.

Hayashi, Akitoshi et al., "Mechanochemical synthesis of amorphous solid electrolytes using SiS2 and various lithium compounds," Solid State Ionics 175 (2004) 637-640, Dec. 9, 2003.

Hayashi, Akitoshi et al., "Preparation and ionic conductivity of Li7P3S11-z glass-ceramic electrolytes," Journal of Non-Crystalline Solids 356 (2010) 2670-2673.

Hirota, Yukihiro and Osamu Mikami, "Energy Barrier Height Measurements of Chemically Vapour Deposited, P3N5 Films by Internal Photoinjection", Thin Solid Films, vol. 162, (Aug. 1988), pp. 41-47.

Hoffman, E. E., "Solubility of Nitrogen and Oxygen in Lithium and Methods of Lithium Purification," in Symposium on Newer Metals, ed. R. Jaffee (West Conshohocken, PA: ASTM International, 1960), 195-206. https://doi.org/10.1520/STP46339S.

Johnson, R.W., Hultqvist, A., Bent, S.F., "A brief review of atomic layer deposition: from fundamentals to applications", Materials today, (Jun. 1, 2014), 17(5):236-46.

Jones, Steven D. et al., "A thin-film solid-state microbattery," Journal of Power Sources, 43-44 (1993) 505-513.

(56) References Cited

OTHER PUBLICATIONS

JP Notice of Reasons for Rejection dated Oct. 5, 2021, in application No. JP20200181662 with English translation.
JP Office Action dated Jan. 4, 2023, in Application No. JP2020-181662 with English translation.
JP Office Action dated May 31, 2022, in Application No. JP2020-181662 with English translation.
Kanno, R. and M. Murayama, "Lithium ionic conductor thio-LISICON: the Li2 S GeS2 P 2 S 5 system", Journal of the electrochemical society, (Jun. 5, 2001), 148(7):A742.
Kato, A. et al., "High-Temperature Performance of All-Solid-State Lithium-Metal Batteries Having Li/$Li_3PS_4$ Interfaces Modified with Au Thin Films", Journal of the Electrochemical Society, 2018, vol. 165, No. 9, pp. A1950-A1954.
Kennedy, J.H., "Ionically conductive glasses based on SiS2," Materials Chemistry and Physics, 23 (1989) 29-50.
Kennedy, John H. et al., "Improved stability for the SiS2—P2S5—Li2S—LiI glass system," Solid State Ionics 28-30 (1998) 726-728.
Kennedy, John H. et al., "Ionically conductive sulfide-based lithium glasses," Journal of Non-Crystalline Solids 123 (1990) 328-338.
Kennedy, John H. et al., "Preparation and conductivity measurements of SiS2—Li2S glasses doped with LiBr and LiC1," Solid State Ionics 18 & 19 (1986) 368-371.
Kitaura, Hirokazu et al., "Fabrication of electrode-electrolyte interfaces in all-solid-state rechargeable lithium batteries by using a supercooled liquid state of the glassy electrolytes," J. Mater. Chem., 2011, 21, 118.
Kondo, S. et al., "New lithium ion conductors based on Li2S—SiS2 system," Solid State Ionics 53-56 (1992) 1183-1186.
KR Office Action dated Jun. 23, 2022 in Application No. KR10-2017-7018176 with English translation.
Levason, Bill and Andrew L. Hector (eds.), "Chemistry and Applications of Metal Nitrides," (Preface only), Coordinated Chemistry Reviews, vol. 257, Issues 13-14, (Jul. 2013), p. 1945.
Li, Xuemin et al., "Facile Synthesis of Lithium Sulfide Nanocrystals for Use in Advanced Rechargeable Batteries", ACS Appl. Mater. Interfaces, (Dec. 3, 2015), 7, 51, 28444-28451.
Maier-Komor, P., "Preparation of Phosphorus Targets Using the Compound Phosphorus Nitride", Nuclear Instruments and Methods in Physics Research Section A: Accelerators, Spectrometers, Detectors and Associated Equipment, vol. 257, Issue 1, (Jun. 1, 1987), pp. 1-3.
Malugani, J.P. et al., "Preparation and electrical properties of the 0,37 Li2S—0,18P2S5-0,45 LiI glass," Solid State Ionics 1 (1980) 519-523.
Mercier, René et al., "Superionic conduction in Li2S—P2S5-LiI—glasses," Solid State Ionics. (Oct. 1981) 5:663-666.
Mexican Office Action dated Oct. 20, 2022 issued in Application No. MX/a/2017/007265 with English translation.
Minami, Keiichi et al., "Electical and electrochemical properties of glass-ceramic electrolytes in the systems Li2S—P2S5—P2S3 and Li2S—P2S5—P2O5," Solid State Ionics 192 (2011) 122-125.
Minami, Keiichi et al., "Mechanochemical synthesis of Li2S—P2S5 glass electrolytes with lithium salts," Solid State Ionics 181 (2010) 1505-1509.
Minami, Keiichi et al., "Preparation and characterization of lithium ion conducting Li2S—P2S5—GeS2 glasses and glass-ceramics," Journal of Non-Crystalline Solids 356 (2010) 2666-2669.
Minami, Tsutomu et al., "Preparation and characterization of lithium ion-conducting oxysulfide glasses," Solid State Ionics 136-137 (2000) 1015-1023.
Mizuno, F., et al. "High lithium ion conducting glass-ceramics in the system Li2S—P2S5", Solid State Ionics, (Oct. 31, 2006), 177(26-32):2721-5.
Mizuno, Fuminori et al., "All Solid-state Lithium Secondary Batteries Using High Lithium Ion Conducting Li2S—P2S5 Glass-Ceramics", Chemistry Letters 2002, No. 12, The Chemical Society of Japan, (Dec. 5, 2002), 31(12):1244-1245 (with 2 cover pages).
Mizuno, Fuminori et al., "Lithium ion conducting solid electrolytes prepared from Li2S, elemental P and S," Solid State Ionics 177 (2006) 2753-2757.
Mizuno, Fuminori et al., "New, highly Ion-Conductive Crystals Precipitated from Li2S—P2S5 Glasses", Advanced Materials, (Apr. 4, 2005), 17(7):918-21.
Murayama, M., et al., "Material design of new lithium ionic conductor, thio-LISICON, in the Li2S—P2S5 system", Solid State Ionics, (May 31, 2004), 170(3-4):173-80.
Non-Final Office Action for U.S. Appl. No. 14/954,812, dated Aug. 1, 2018.
Non-Final Office Action for U.S. Appl. No. 14/954,816, dated Aug. 1, 2018.
Non-final Office Action for U.S. Appl. No. 15/726,302, dated Apr. 16, 2020.
Non-final Office Action for U.S. Appl. No. 15/726,302, dated Sep. 10, 2021.
Non-final Office Action for U.S. Appl. No. 16/161,720, dated Apr. 28, 2020.
Non-Final Office Action for U.S. Appl. No. 16/174,058, dated Sep. 17, 2021.
Non-final Office Action for U.S. Appl. No. 16/179,803, dated Apr. 28, 2020.
Non-final Office Actions for U.S. Appl. No. 15/380,989, dated Mar. 26, 2019.
Notice of Allowance, dated Mar. 10, 2020, for Chinese Patent Application No. 201580075233.0, with English Translation.
Notice of Allowance dated Oct. 1, 2021, in U.S. Appl. No. 16/781,713.
Notice of Allowance for U.S. Appl. No. 14/954,812, dated Oct. 30, 2018.
Notice of Allowance for U.S. Appl. No. 14/954,816, dated Oct. 15, 2018.
Notice of Allowance for U.S. Appl. No. 15/380,989, dated Dec. 6, 2019.
Notice of Allowance for U.S. Appl. No. 16/012,588, dated Dec. 3, 2019.
Notice of Allowance for U.S. Appl. No. 16/161,720, dated Aug. 6, 2020.
Notice of Allowance for U.S. Appl. No. 16/179,803, dated Aug. 11, 2020.
Notice of Allowance for U.S. Appl. No. 16/341,872, dated Aug. 21, 2020.
Notice of Allowance for U.S. Appl. No. 16/341,874, dated Sep. 3, 2020.
Notice of Allowance for U.S. Appl. No. 16/663,177, dated Sep. 3, 2020.
Notice of Allowance for U.S. Appl. No. 15/929,959, dated Aug. 4, 2021.
Notice of Allowance for U.S. Appl. No. 15/929,959, dated Jul. 12, 2021.
Notice of Intention to Grant, dated Jan. 26, 2021, for European Patent Application No. 15864779.2, 7 Pages.
Notice of Reasons for Rejection, dated Jan. 14, 2020, for Japanese Patent Application No. 2017-529785, with machine translation.
Notice of Reasons for Rejection, dated May 24, 2019, for Japanese Patent Application No. 2017-529785, with machine translation.
Ohtomo, Takamasa et al., "All-solid-state lithium secondary batteries using the 75Li2S•25P2S5glass and the 70Li2S•30P2S5 glass-ceramic as solid electrolytes," Journal of Power Sources 233 (2013) 231-235.
Ohtomo, Takamasa et al., "Electrical and electrochemical properties of Li2S—P2S5—P2—O5 glass-ceramic electrolytes," Journal of Power Sources 146 (2005) 715-718.
Ohtomo, Takamasa et al., "Mechanochemical synthesis of lithium ion conducting glasses and glass-ceramics in the system Li2S—P—S," Solid State Ionics 176 (2005) 2349-2353.
Park., 2013.—(machine translation), 13 pages.
Pradel, Annie et al., "Electrical properties of lithium conductive silicon sulfide glasses prepared by twin roller quenching," Solid State Ionics 18 & 19 (1986) 351-355.
Restriction Requirement for U.S. Appl. No. 15/380,989, dated Jul. 5, 2018.

(56) References Cited

OTHER PUBLICATIONS

Restriction Requirement for U.S. Appl. No. 15/726,302, dated May 6, 2019.
Restriction Requirement for U.S. Appl. No. 15/726,302, dated Nov. 19, 2019.
Restriction Requirement for U.S. Appl. No. 16/174,058, dated Apr. 16, 2020.
Rudolph, B. et al., "Cyclic voltammetry studies of the lithiumthioborate glass-indium interface," Electrochimica Acta, vol. 34, No. 11, pp. 1519-1521, 1989.
Sahami, Saeed et al., "Preparation and conductivity measurements of SiS2—Li2S—LiBr lithium ion conductive glasses," Journal of the Electrochemical Society, Apr. 1985, pp. 985-986.
Sakuda, Atsushi et al., "Sulfide solid electrolyte with favorable mechanical property for all-solid-state lithium battery," Scientific Reports 3:2261, Jul. 23, 2013.
Second Office Action, dated Nov. 15, 2019, for Chinese Patent Application No. 201580075233.0, with English Translation.
Senevirathne, K. et al., "A New Crystalline LiPON Electrolyte: Synthesis, Properties, and Electronic Structure", Solid State Ionics, Feb. 21, 2013, vol. 233, pp. 95-101.
Svensson PH, Kloo L. Synthesis, structure, and bonding in polyiodide and metal iodide—iodine systems. Chemical Reviews. (Mar. 22, 2003), 103(5):1649-84.
Tatsumisago, M., et al., "Superionic conduction in rapidly quenched Li2S—SiS2—Li3PO4 glasses", Journal of the Ceramic Society of Japan, (Nov. 1, 1993), 101(1179):1315-7.
Tatsumisago, Masahiro et al., "Preparation and structure of lithium-ion-conducting mixed-anion glasses in the system LiBO2—LiBS2," J. Am. Ceram. Soc., 71 [9] 766-69 (1988).
Tatsumisago, Masahiro et al., "Recent development of sulfide solid electrolytes and interfacial modification for all-solid-state rechargeable lithium batteries," Journal of Asian Ceramic Societies 1 (2013) 17-25.
Tatsumisago, Masahiro, "Glassy materials based on Li2S for all-solid-state lithium secondary batteries," Solid State Ionics 175 (2004) 13-18.
Thangadurai, V. et al., "Novel fast lithium ion conduction in garnet-type $Li_5La_3M_2O_{12}$ (M=Nb, Ta)", Journal of the American Ceramic Society, Mar. 2003, vol. 86, No. 3, pp. 437-440.
Trevey, James et al., "Glass-ceramic Li2S—P2S5 electrolytes prepared by a single step ball billing process and their appliction for all-solid-state lithium-ion batteries," Electrochemistry Communications 11 (2009) 1830-1833.
U.S. Restriction Requirement dated Aug. 31, 2022 in U.S. Appl. No. 16/949,026.
U.S. Corrected Notice of Allowance dated Jun. 13, 2022, in U.S. Appl. No. 16/948,863.
U.S. Non Final Office Action dated Feb. 2, 2023 in U.S. Appl. No. 16/949,026.
U.S. Non-Final office Action dated Oct. 27, 2022 in U.S. Appl. No. 16/948,835.
U.S. Non-Final Office Action dated Dec. 23, 2022 in U.S. Appl. No. 16/784,162.
U.S. Non-Final Office Action dated Nov. 18, 2022, in U.S. Appl. No. 16/948,836.
U.S. Notice of Allowance dated May 12, 2022, in U.S. Appl. No. 16/948,863.
U.S. Notice of allowance dated Dec. 9, 2022 in U.S. Appl. No. 17/248,225.
U.S. Notice of Allowance dated Jan. 9, 2023 in U.S. Appl. No. 16/948,836.
U.S. Notice of Allowance dated Jan. 19, 2023 in U.S. Appl. No. 16/948,836.
US Notice of Allowance dated Oct. 20, 2021, in U.S. Appl. No. 16/781,713.
U.S. Appl. No. 16/948,864, inventors Visco et al., filed Oct. 2, 2020.
U.S. Appl. No. 17/813,463, Inventors Visco et al., filed Jul. 19, 2022.
U.S. Appl. No. 17/817,494, Inventors Visco et al., filed Aug. 4, 2022.
U.S. Appl. No. 17/934,470, inventors Visco et al., filed Sep. 22, 2022.
U.S. Appl. No. 18/048,400, inventors Visco et al., filed Oct. 20, 2022.
U.S. Restriction Requirement dated Dec. 23, 2022 in U.S. Appl. No. 16/556,736.
U.S. Restriction Requirement dated Jan. 18, 2023 in U.S. Appl. No. 17/303,707.
U.S. Restriction Requirement dated Nov. 3, 2022 in U.S. Appl. No. 16/509,385.
Visco, Steven J. et al., "Complex plane and 7Li NMR studies of arsenic sulfide-based lithium glasses," J. Electrochem. Soc.: Solid-State Science and Technology, Jul. 1985, pp. 1766-1770.
Visco, Steven J. et al., "Complex plane and 7Li NMR studies of highly conductive sulfide-based lithium glasses," Battery Testing, vol. 132, No. 4, pp. 751-753.
Wada, H., et al., "Preparation and ionic conductivity of new B2S3—Li2S-Lil glasses", Materials research bulletin, (Feb. 1, 1983), 18(2):189-93.
Wenzel, Sebastian et al., "Interphase formation and degradation of charge transfer kinetics between a lithium metal anode and highly crystalline Li7P3S11 solid electrolyte", Solid State Ionics, (Mar. 1, 2016), 286:24-33.
WO patent application No. PCT/US2015/063231, International Search Report and Written Opinion mailed Mar. 11, 2016.
WO patent application No. PCT/US2015/063234, International Search Report and Written Opinion mailed Apr. 1, 2016.
WO patent application No. PCT/US2016/067338, International Preliminary Report on Patentability, dated mailed Jul. 5, 2018.
WO patent application No. PCT/US2016/067338, International Search Report and Written Opinion mailed May 19, 2017.
WO patent application No. PCT/US2018/039862, International Search Report and Written Opinion mailed Oct. 19, 2018.
WO patent application No. PCT/US2018/039862, Invitation to Pay Additional Fees and, where applicable, Protest Fee, dated Aug. 28, 2018.
WO patent application No. PCT/US2018/042476, Invitation to Pay Additional Fees and, where applicable, Protest Fee, dated Sep. 12, 2018.
Yang, M. et al., "Membranes in lithium ion batteries," Membranes, Jul. 4, 2012, vol. 2, pp. 367-383.
Annika B., et al., "Lithium-Ion Conducting Thin-Films for Solid-State Batteries prepared by Chemical Solution Deposition," Justus-Liebig-Universitat Gieen, 2018, 190 Pages.
BR Office Action dated Aug. 3, 2022, in Application No. BR112017011768-1, with English Translation.
Flexible Graphite Foil as viewed at https://hpmsgraphite.com/graphitefoil using the Wayback machine (Year: 2004).
Flexible Graphite Foil as viewed at https://hpmsgraphite.com/graphitefoil via the Wayback archive (Year: 2018).
HPMS HP Materials Solutions Inc., "Flexible Graphite Foil", The Wayback Machine, 2021, pp. 1-7.
Ko, Y., et al., "Influence of Process Conditions on Structural and Electrochemical Properties of Lithium Phosphorus Oxynitride Thin Films," Ceramics International, 2020, vol. 46, pp. 20623-20632.
KR Office Action dated Nov. 23, 2023, in KR Application No. 10-2023-7010384 with English translation.
Lau, J., et al., "Sulfide Solid Electrolytes for Lithium Battery Applications," Advanced Energy Materials, 2018, vol. 8, pp. 1-24.
Liu G., et al., "Highly Selective Lithium Recovery from High Mg/Li Ratio Brines," Desalination, Jan. 2020, vol. 474, pp. 1-7.
Lopez-Aranguren, P., et al., "Crystalline Li PON as a Bulk-Type Solid Electrolyte," ACS Energy Letters, 2021, vol. 6 (2), pp. 445-450.
Mascaraque, N., et al., "Structure and Electrical Properties of a New Thin-phosphorus Oxynitride Glass Electrolyte," Journal of Non-Crystalline Solids, 2014, vol. 405, pp. 159-162.
Panasonic Industry "PGS" Graphite Sheets as viewed at 2021.
Pradel, A., et al., "Lithium Chalcogenide Conductive glasses, " Materials Chemistry and Physics, 1989, vol. 23, pp. 121-142.

(56) References Cited

OTHER PUBLICATIONS

Sandfire Scientific., "Quartz Ampoules Coated with Layer of Pyrolyzed Carbon," 2015, pp. 1-2. https://sandfire.com/quartz-ampoules-coated-with-layer-of-pyrolyzed-carbon/.
Trim-Lok., "Plastic Trims & Edge Guards," Trim-Lok, Inc., Jan. 2015, pp. 1-5.
U.S. Corrected Notice of Allowance dated Apr. 1, 2025 in U.S. Appl. No. 17/654,648.
U.S. Corrected Notice of Allowance dated Mar. 17, 2025 in U.S. Appl. No. 17/249,864.
U.S. Corrected Notice of Allowance dated Sep. 20, 2023, in U.S. Appl. No. 18/175,374.
U.S. Final Office Action dated Feb. 5, 2026 in U.S. Appl. No. 17/934,470.
U.S. Final Office Action dated Jan. 16, 2024 in U.S. Appl. No. 17/243,429.
U.S. Final Office Action dated Jul. 29, 2024 in U.S. Appl. No. 17/453,033.
U.S. Final Office Action dated Mar. 6, 2023 in U.S. Appl. No. 16/948,835.
U.S. Final Office Action dated Mar. 11, 2026 in U.S. Appl. No. 17/816,592.
U.S. Final office Action dated Oct. 6, 2023 in U.S. Appl. No. 16/556,736.
U.S. Final Office Action dated Oct. 27, 2023 in U.S. Appl. No. 16/949,026.
U.S. Non Final Office Action dated Mar. 31, 2023 for U.S. Appl. No. 16/556,736.
U.S. Non-Final Office Action dated Apr. 11, 2023 in U.S. Appl. No. 17/303,707.
U.S. Non-Final Office Action dated Apr. 15, 2025 in U.S. Appl. No. 17/934,470.
U.S. Non-Final Office Action dated Aug. 18, 2023, in U.S. Appl. No. 17/303,706.
U.S. Non-Final Office Action dated Aug. 19, 2024 in U.S. Appl. No. 17/658,646.
U.S. Non-Final Office Action dated Dec. 4, 2023 in U.S. Appl. No. 17/302,027.
U.S. Non-Final Office Action dated Dec. 6, 2024 in U.S. Appl. No. 18/671,772.
U.S. Non-Final Office Action dated Dec. 7, 2023 in U.S. Appl. No. 17/303,708.
U.S. Non-Final Office Action dated Dec. 18, 2024 in U.S. Appl. No. 17/650,770.
U.S. Non-Final Office Action dated Dec. 27, 2024 in U.S. Appl. No. 17/658,645.
U.S. Non-Final Office Action dated Feb. 13, 2025 in U.S. Appl. No. 18/671,779.
U.S. Non-Final Office Action dated Feb. 19, 2026 in U.S. Appl. No. 18/529,777.
U.S. Non-Final Office Action dated Jan. 5, 2024 in U.S. Appl. No. 17/453,033.
U.S. Non-Final Office Action dated Jan. 10, 2025 in U.S. Appl. No. 17/648,120.
U.S. Non-Final Office Action dated Jan. 28, 2026 in U.S. Appl. No. 18/349,770.
U.S. Non-Final Office Action dated Jun. 7, 2023, in U.S. Appl. No. 17/243,429.
U.S. Non-Final Office Action dated Mar. 13, 2025 in U.S. Appl. No. 18/671,767.
U.S. Non-Final Office Action dated Mar. 14, 2024 in U.S. Appl. No. 17/301,453.
U.S. Non-Final Office Action dated Mar. 14, 2025 in U.S. Appl. No. 18/048,400.
U.S. Non-Final Office Action dated Mar. 18, 2025 in U.S. Appl. No. 17/654,233.
U.S. Non-Final Office Action dated Mar. 18, 2025 in U.S. Appl. No. 17/813,463.
US Non-Final Office Action dated May 6, 2025 in U.S. Appl. No. 18/463,206.
U.S. Non-Final Office Action dated Nov. 14, 2024 in U.S. Appl. No. 17/658,639.
U.S. Non-Final Office Action dated Oct. 2, 2025 in U.S. Appl. No. 17/816,592.
U.S. Non-Final Office Action dated Oct. 23, 2024 in U.S. Appl. No. 18/333,282.
U.S. Notice of Allowance dated Apr. 15, 2024 in U.S. Appl. No. 17/303,706.
U.S. Notice of Allowance dated Apr. 30, 2025 in U.S. Appl. No. 18/671,779.
U.S. Notice of Allowance dated Aug. 1, 2025 in U.S. Appl. No. 18/463,206.
U.S. Notice of Allowance dated Feb. 15, 2024 in U.S. Appl. No. 16/721,787.
U.S. Notice of Allowance dated Jan. 15, 2025 in U.S. Appl. No. 18/671,772.
U.S. Notice of Allowance dated Jan. 30, 2024 in U.S. Appl. No. 16/721,787.
U.S. Notice of Allowance dated Jun. 20, 2023 in U.S. Appl. No. 16/509,385.
U.S. Notice of Allowance dated Mar. 11, 2025 in U.S. Appl. No. 17/249,864.
U.S. Notice of Allowance dated Mar. 12, 2025 in U.S. Appl. No. 17/654,648.
U.S. Notice of Allowance dated Mar. 15, 2023 in U.S. Appl. No. 16/948,835.
U.S. Notice of Allowance dated Mar. 20, 2023 in U.S. Appl. No. 17/817,494.
U.S. Notice of Allowance dated Mar. 27, 2024 in U.S. Appl. No. 17/302,491.
U.S. Notice of Allowance dated May 8, 2024 in U.S. Appl. No. 17/303,707.
U.S. Notice of Allowance dated May 8, 2024 in U.S. Appl. No. 17/303,708.
U.S. Notice of Allowance dated Oct. 17, 2024 in U.S. Appl. No. 18/191,615.
U.S. Notice of Allowance dated Sep. 12, 2023 in U.S. Appl. No. 18/175,374.
U.S. Notice of Allowance dated Sep. 23, 2025 in U.S. Appl. No. 18/048,400.
U.S. Notice of Allowance dated Sep. 30, 2025 in U.S. Appl. No. 18/671,767.
U.S. Appl. No. 18/590,753, inventor Visco S, filed Feb. 28, 2024.
U.S. Restriction requirement dated Apr. 3, 2023 in U.S. Appl. No. 17/303,706.
U.S. Restriction Requirement dated Apr. 24, 2025 in U.S. Appl. No. 17/816,592.
U.S. Restriction requirement dated May 18, 2023, in U.S. Appl. No. 16/721,787.
Wikipedia., "Sintering", The Free Encyclopedia, 2023, pp. 1-15.

* cited by examiner

METHODS AND APPARATUSES FOR LI EXTRACTION AND GENERATION OF HIGH PURITY LITHIUM HYDROXIDE

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in its entirety and for all purposes.

BACKGROUND

Field and Related Art

The present disclosure relates to extraction, purification, and production of a lithium substance. More particularly, this disclosure provides methods, systems, sub-systems/apparatuses, and components for electrochemically extracting and/or purifying and/or producing high purity lithium hydroxide (e.g., $LiOH{\cdot}H_2O$) from a liquid source such as a Li feedstock solution from an oil field or geothermal brine.

There is an increasing demand for Li precursor materials such as lithium hydroxide and lithium carbonate that is driven by the extensive and expanding use of Li-ion batteries and the projected need to support vehicle electrification. Currently the main sources of Li are mineral ores, predominately found in hard rock mines in Australia and China, and brine deposits that are found underneath dry lakebeds known as salars, for example in Chile and Argentina. Lithium recovery from hard rock mines and salars impose a significant negative environmental impact, and there is a need for lithium recovery with a lower environmental footprint. Hard rock mining commonly employs acid digestion, which involves energy-intensive roasting and labor-intensive acid leaching. Lithium is generally extracted from brines using large evaporative ponds that take more than a year to process and are associated with environmental issues and inefficiencies with respect to metals contamination. Many other brines, such as geothermal and oilfield, exist in various and more evenly distributed locations around the world. Unfortunately, these brines have lower lithium concentrations and higher impurity concentrations and are therefore more challenging to process. However, such brines represent a significant supply that can be used to meet domestic demand for lithium in various locations around the world. The Salton Sea represents one such US domestic geothermal brine with significant Li reserves. Accordingly, there remains a growing need for new and improved Li recovery processes and related Li extraction plants and associated apparatuses.

SUMMARY

In one aspect the present disclosure provides methods for Li extraction that involve a dry transfer electrolysis process for extracting, enriching, purifying and/or producing an aqueous Li substance as a primary product from a liquid Li input solution that is derived from a Li resource, such as a geothermal or oilfield brine. In various embodiments the Li resource is a natural or synthetic Li brine, a Li containing ore such as spodumene, or spent Li batteries processed into a Li containing slurry. In accordance with embodiments of the present disclosure a liquid Li input solution undergoes a dry Li transfer electrolysis process that generates an aqueous lithium hydroxide slurry as a primary intermediate product. In various embodiments the aqueous lithium hydroxide slurry or supersaturated solution is an intermediate product of exceptional purity that is further processed into a high purity lithium hydroxide monohydrate powder, preferably devoid of any measurable amount of contaminating monovalent and divalent cations, such as Na ions, Ca ions, and Mg ions.

In one aspect the present disclosure provides a Li extraction plant for extracting lithium from a lithium containing resource, including mineral ores, brines, or spent batteries. In various embodiments the Li extraction plant includes a dry transfer Li electrolysis circuit that is staged within the plant among other upstream and/or downstream circuits. For instance, the plant including a solid particulate filtration circuit positioned upstream of the dry transfer Li electrolysis circuit of the present disclosure and a drying/evaporating circuit positioned downstream of said electrolysis circuit.

In other aspects the present disclosure provides a dry transfer Li electrolysis circuit and a dry transfer Li electrolysis unit thereof that is configured for dry transferring Li ions from an aqueous Li input solution to an aqueous Li output solution. In accordance with the present disclosure the dry transfer electrolysis unit includes one or more dry transfer electrolysis cells wherein Li ions are dry transferred from an anode section, configured to receive a liquid Li brine, to a cathode section, wherein the Li substance is generated (e.g., an aqueous lithium hydroxide slurry) as a final or, more typically, an intermediate product. By dry transfer it is meant that Li ions transfer from the anode section to the cathode section without the co-migration or co-diffusion of liquid molecules.

In yet another aspect the present disclosure provides a dry transfer electrolysis cell having an anode-electrode and a cathode-electrode disposed in an anode and cathode chamber respectively, wherein the anode chamber and cathode chamber are partitioned by a Li ion conducting wall structure component, which enables dry Li ion transfer by preventing co-migration and diffusion of water molecules there through. In accordance with the present disclosure the Li ion conducting wall structure component includes one or more substantially impervious Li ion conducting ceramic membranes that are preferably single Li ion conductors with high selectivity for electrically migrating Li ions relative to other monovalent and divalent cations. By use of the term substantially impervious it is meant that the Li ion conducting ceramic membrane is chemically compatible with, and impervious to, liquid molecules that it operably contacts during the Li extraction process. In various embodiments the substantially impervious Li ion conducting ceramic membrane is a dense sintered sheet (e.g., having a long edge or diameter that is less than 25 cm), and the wall structure is composed of a macro-array of such sintered sheets configured into a wall structure by means of fixing the membrane array using a substantially impervious bonding agent (e.g., the wall structure having a long edge or diameter that is at least 30 cm, and more typically at least 60 cm). Preferably, the wall structure is free of defects through which a modicum of water may seep across and the dense sintered membrane sheets, from which it is manufactured, are pinhole free. In various embodiments the substantially impervious Li ion conducting ceramic material from which the membrane and wall structure are composed is a lithium metal phosphate ceramic Li ion conductor (e.g., such as those commonly referred to has LATP and the like) or a perovskite type oxide Li ion conductor (e.g., such as those commonly referred to has LLTO and the like). For instance, one example of LATP has composition $Li_{1.3}Al_{0.3}Ti_{1.7}(PO_4)_3$, and one example of LLTO is $La_{0.57}Li_{0.29}TiO_3$.

The methods and apparatuses of the present disclosure enable dry transfer of Li ions from a liquid Li source to a Li substance material on the product side of the electrolysis unit. In accordance with these various aspects and embodiments, the present disclosure also provides a fully or partially solid-state wall structure component that supports Li ion migration but is substantially impervious to liquid molecules that it comes into contact with during cell operation.

In various aspects, methods are provided to extract and/or purify a liquid Li source and/or produce lithium hydroxide from a liquid Li source using an electrolysis process that involves a substantially dry transfer of Li ions from an input side of an electrolytic cell to the output side of the cell.

In various embodiments the input side of the cell is anodic, and the output side is cathodic. The anode side may be defined, in part, by an anode chamber/compartment wherein a liquid anolyte and an anode-electrode are dispensed and positioned, respectively. And likewise, the cathode side having a cathode chamber having liquid catholyte and a cathode-electrode incorporated therein. In accordance with the present disclosure, the input and output sides of the electrolysis cell(s) are partitioned by a wall structure that supports Li ion communication between the sides while preventing liquid anolyte and liquid catholyte molecules from transferring there between.

In various embodiments the dry transfer electrolysis process is integrated as part of a Li extraction plant that includes upstream processing steps, which may involve one or more steps for conditioning the liquid Li source into an anolyte feedstock solution. In various embodiments, one object of the present disclosure is to provide an electrolysis process that simplifies or eliminates one or more of the upstream steps.

In various embodiments the dry transfer electrolysis process of the present disclosure serves to extract, purify, and produce a lithium hydroxide final product (or intermediate product) directly from a Li source brine in a single step. In other embodiments the dry transfer electrolysis process is integrated into a Li extraction plant wherein the source brine is treated and conditioned to form a Li anolyte solution that is fed or flowed into the anode chamber.

In a particular embodiment the dry transfer electrolysis process of the present disclosure produces a super purity lithium hydroxide product of the highest value. For instance, the aqueous Li feedstock is conditioned and treated according to methods known to those of skill in the art, producing a feedstock with exceptionally low impurity levels, and the dry transfer process produces hydroxide in the catholyte with exceptional purity, as contaminants from the feedstock are unable to cross the wall structure. For instance, in such instances the final purity of the product has immeasurable amounts of cations other than Li and is devoid of chlorine and sulfate anions.

In one embodiment the Li source brine is a high Mg brine. In one embodiment the Li source brine is a high sulfate brine. In other embodiments the Li source brine is derived from the recycling of spent Li batteries.

The liquid Li source may be natural or synthetic. Examples include Li brines and Li slurries, such as geothermal or oilfield brines and slurries produced from recycled products, especially spent Li batteries. In various embodiments the method includes: i) providing an electrochemical cell, or cell system, having an anode-electrode in an anode chamber and a cathode-electrode in a cathode chamber, wherein the anode and cathode chambers are in Li ion communication with each other but otherwise physically separated by a Li ion conductive wall structure component that is highly selective for Li ion transport and substantially impervious to molecules (e.g., water molecules or organic molecules) present in the anode and cathode chambers; ii) dispensing, or otherwise flowing, a liquid anolyte solution (e.g., an aqueous pre-fractionated LiCl solution, a Li-containing brine, or Li-containing slurry) into and/or through the anode chamber; dispensing, and/or flowing, a liquid catholyte solution (e.g., an aqueous Li containing solution) into and/or through the cathode chamber; iv) applying an electric potential across the anode and cathode electrodes to effectuate an electrochemical redox reaction wherein anolyte/catholyte species are electrochemically oxidized/reduced and charge balance is maintained by dry transferring Li ions from the anolyte to the catholyte via the wall structure; and wherein the process leads to the formation of a lithium substance as a primary product typically dissolved or partially dissolved and precipitated as components of a catholyte slurry.

For instance, in a particular embodiment the lithium substance intermediate product is an aqueous lithium hydroxide solution or slurry thereof, and the process involves electro-oxidizing Cl anions present in the anolyte to form $Cl_2$ molecules (e.g., chloride gas), electro-reducing water molecules of the catholyte to form $H_2$ molecules (e.g., hydrogen gas), and dry transferring Li ions, via electrical migration, across the wall structure from the anolyte to the catholyte; the process leading to the formation of a lithium substance as the primary product, typically dissolved or partially dissolved in the catholyte (e.g., an aqueous lithium hydroxide solution).

The electrochemical processing step of the present disclosure may be used for continuous processing or batch processing. In various embodiments the electrochemical processing step of the present disclosure is a continuous flow-through process wherein the catholyte and anolyte are caused to continuously flow through their respective chambers, or the electrochemical step is configured as batch process (e.g., with periodic conditioning of the catholyte and anolyte) or as a hybrid process wherein one or the other of the anolyte and catholyte, but not both, are caused to continuously flow.

In another aspect, an electrochemical cell is provided that includes a wall structure capable of dry transferring Li ions from an anolyte to a catholyte.

In various embodiments the cell has a bi-cell architecture wherein the wall structure divides and separates the anode and cathode chambers and prevents mixing of anolyte molecules and catholyte molecules, and preferably only allows dry transfer of Li ions therebetween. In other embodiments it is contemplated that the cell may be configured with sub-sections within the anode and/or cathode chambers. In various embodiments the catholyte compartment includes a first and second chamber defined by the position of a second wall structure component or membrane layer typically in the form of a sheet, such as an ion exchange membrane.

In another aspect, a wall structure is provided that is capable of dry transferring Li ion from an anolyte to a catholyte.

In various embodiments the wall structure includes a substantially liquid impervious Li ion conducting membrane that is highly conductive of Li ions and has high selectivity of Li ions such that it minimizes or eliminates contamination of the primary Li substance product with impurity ions present in the anolyte. Preferably the Li ion conducting membrane is substantially chemically compatible in direct contact with the anolyte and catholyte solutions. In various embodiments the Li ion conducting membrane is a continuous sheet of a Li ion conducting ceramic material. In various embodiments the membrane may be a macro-array of distributed membrane sections. In various embodiments the membrane may be an engineered micro-array of distributed membrane component particles wherein the component particles have first and second surfaces that define, in part, the overall first and second surfaces of the membrane itself.

In various embodiments the wall structure is a multi-layer laminate of the substantially liquid impervious Li ion conducting membrane and one or more additional material layers. In a particular embodiment the wall structure is a dual layer that includes as a second material layer a cationic exchange membrane that is highly resistant to chemical attack by the catholyte but otherwise may be chemically incompatible with the anolyte. In other embodiments it is a tri-layer with the substantially liquid impervious membrane sandwiched between a second material layer that is chemically compatible with the anolyte and a third material layer that is chemically compatible with the catholyte.

In various embodiments the flow of anolyte and/or catholyte (e.g., the catholyte) is controlled relative to (or in conjunction with) the rate of electrochemical redox to maintain a predetermined threshold pH value of the catholyte solution adjacent to the cathode side wall chamber. For instance, the catholyte flow rate is adjusted relative to the electrochemical redox rate to maintain the catholyte solution at or nearby the wall structure to a pH of about 10 or about 11, or about 12, or about 13, or about 14 (e.g., between 9 to 10, or between 10 to 11, or between 11-12, or between 12-13, or between 13-14).

In one particular embodiment the method involves producing lithium hydroxide in the cathode section from an aqueous LiCl anolyte solution that has been pre-fractionated to reduce the presence of one or more of Mg, Ca, and Na ions, as well as inorganic impurities of Si, B and Fe, and organic impurities as are often present in brines.

In various embodiments the method involves i) providing an electrochemical cell or cell system having an anode-electrode in an anode compartment and a cathode-electrode in a cathode compartment, wherein the anode and cathode compartments are in Li ion communication; ii) dispensing, or otherwise flowing, an aqueous LiCl feedstock solution/slurry/brine into and/or through the anode compartment of the cell; iii) dispensing, and/or flowing, an aqueous solution into and/or through the cathode compartment of the cell; iv) applying an electric potential across the anode and cathode electrode to effectuate an electrochemical redox reaction wherein the LiCl feedstock solution undergoes electrochemical oxidation and the aqueous solution of the cathode compartment undergoes electrochemical reduction; and v) extracting a lithium substance that is formed in the cathode compartment as a result of the electrochemical redox, and, in particular, wherein the lithium substance is or is composed of an aqueous lithium hydroxide solution. In various embodiments the wall structure is planar or substantially planar. In other embodiments the wall structure is cylindrical or substantially cylindrical, such as tubular shaped. In various embodiments one or both the anode and cathode compartment(s) have a closed structure. In other embodiments one or both the anode and cathode compartment has an open-ended structure wherein the feedstock solution or lithium substance solution/slurry is caused to flow through a channel of the compartment or the compartment itself is channel-like. For example, the cathode compartment is open-ended and channel-like and the flow rate through the compartment is controlled in conjunction with the rate of electrochemical redox in a manner to maintain the pH of the aqueous lithium substance solution within a desired range (e.g., between pH 7-8, or pH 8-9, or pH 9-10, or Ph 8-10.

In accordance with one aspect of the present disclosure an electrochemical cell and/or electrochemical cell system is provided that includes, or has, one or more Li ion conducting wall structures that partition the cell, or cell system, into regions that effectuate cathode and anode compartments for production of lithium hydroxide. In various embodiments the electrochemical cell has one anode compartment and one cathode compartment. In other embodiments the cell has one anode compartment and multiple cathode compartments (i.e., two or more cathode compartments) or one cathode compartment and multiple anode compartments (i.e., two or more anode compartments). In various embodiments one or both the anode and cathode compartments have an open-ended structure that is configured for flowing one or both of the feedstock solution and/or lithium substance solution. In a particular embodiment the electrochemical cell has a single cathode compartment and multiple tubular wall structures and multiple anode compartments (e.g., two or more tubular shaped or tubular like wall structures and two or more anode compartments). In various embodiments the number of tubular wall structures matches the number of anode compartments. For example, in various embodiments, the anode compartment is formed within the center of the tubular wall structure and the lithium feedstock solution (e.g., aqueous LiCl) is caused to flow through the anode compartment tube, whereas the cathode compartment is in the form a singular surrounding bath that encompasses the anode compartments.

In accordance with one aspect of the present disclosure a Li ion conducting wall structure is provided for use in an electrochemical cell or electrochemical cell system of the present disclosure, which combines the properties of a first substantially impervious Li ion conducting membrane composed in whole or in part of a Li ion conducting inorganic material phase and a water permeable Li ion selective membrane positioned adjacent to the impervious membrane. In various embodiments the impervious membrane provides the physical separation aspect of the wall structure in that it prevents cross contamination between the anode and cathode compartment by solely, or substantially solely, allowing Li ions to migrate through. In various embodiments the wall structure is essentially the substantially impervious Li ion conducting membrane. However, the embodiments of this disclosure are not limited to a single membrane wall structure. In other embodiments the wall structure includes a permeable Li ion selective membrane positioned in the cell to adjacently oppose the impervious membrane, and therewith serve as a layer that assists in mitigating the buildup of hydroxyl ions against the surface of the impervious membrane.

DETAILED DESCRIPTION

Figure 1:
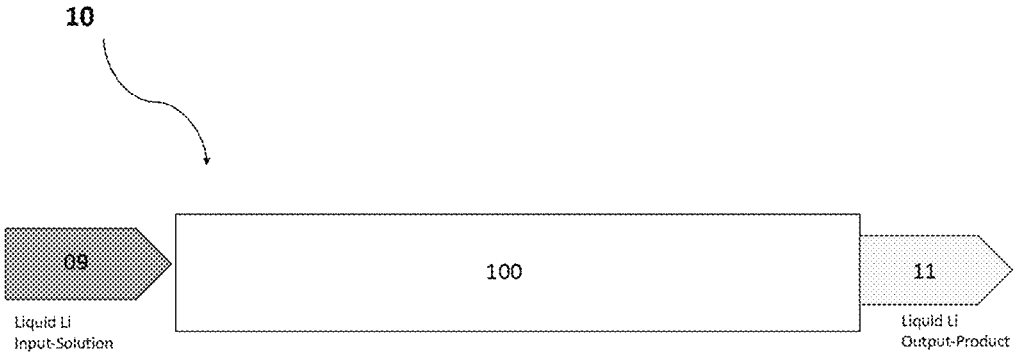
FIG. 1 illustrates a schematic of a dry Li transfer electrolysis circuit in accordance with various embodiments of the present disclosure.

With reference to FIG. 1 there is illustrated a dry Li transfer electrolysis circuit, which, in accordance with various embodiments of the present disclosure, may be configured for use in a chemical plant for extracting and/or producing a primary Li product from a Li containing resource, such as a natural Li brine. Circuit 10 includes dry transfer electrolysis unit 100 which is configured to receive, process, and/or convert a Li-containing input-liquid 09 into a Li-rich output-liquid 11 by transfer of Li ions through the circuit without the co-migration or co-diffusion of liquid molecules. In various embodiments, output-liquid 11 is an intermediary product composed of an aqueous lithium hydroxide solution or supersaturated slurry which is intended to be further processed in a downstream evaporator/drying circuit to form a Li hydroxide monohydrate powder. Electrolysis circuit 10 also includes piping (not shown) for communicating liquids 09/11 into and out of the electrolysis unit 100. Circuit 10 is generally multi-functional. For instance, it can be used for one or more of purification, enrichment, extraction, and/or generation of a Li rich substance directly from a highly contaminated Li brine feedstock.

Figure 2:
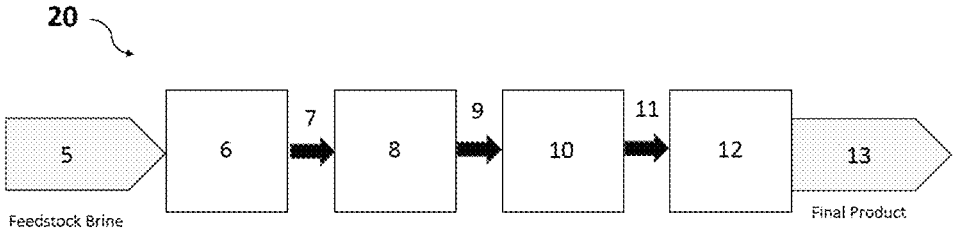
FIG. 2 illustrates a schematic drawing of a chemical plant for extracting Li, in accordance with various embodiments of the present disclosure.

In various embodiments circuit 10 may be configured for use in a continuous or semi-continuous Li-extraction plant. Depending on the physical and chemical makeup of the Li resource and the desired purity of the final product, circuit 10 may be utilized at various stages within the Li extraction plant to support functionality of an upstream or downstream circuit or process. For instance, as illustrated in FIG. 2, circuit 10 may be incorporated in line with upstream and downstream circuits or chemical processing modules, which may be of different or similar functionality (6/8 upstream and 12 downstream), such as filtration circuits, purification circuits, digestion circuits, dissolution circuits, nanofiltration (NF) circuits, ion adsorption circuits, ion-exchange circuits, precipitation circuits, and the like. Circuit 10 is also applicable for batch processing, and in embodiments it is a standalone reactive module with inlet and outlet streams and associated feed/storage tanks. For instance, circuit 10 may be used as a standalone unit for extraction, purification and/or production of a lithium hydroxide slurry. In various embodiments circuit 10 is utilized in a Li extraction plant as the sole unit/module for providing purification, extraction, and conversion. However, in various embodiments, the circuit is employed for a primary purpose(s), such as extraction or conversion, and the purification function, for example, serves to provide a peripheral, yet significant, benefit which may result in an improved product or otherwise simplify an upstream or downstream purification process. For example, as illustrated in FIG. 2, Li extraction plant 20 of the present disclosure includes dry transfer electrolysis circuit 10 configured downstream of a solid particulate filter unit (filter circuit 6), a direct lithium extraction unit (DLE circuit 8) and upstream of circuit 12 (e.g., an evaporative/drying unit). In such an embodiment, the primary functionality of electrolysis circuit 10 is to convert the Li brine to a lithium hydroxide solution/slurry and the extraction/purification capability of circuit 10 serves as a secondary function to enhance the purity of the final generated lithium hydroxide product 13 and/or considerably relax the requirements and/or energy use of upstream circuit 6 and/or circuit 8, and, hence, reduce plant complexity and associated operating costs.

Figure 3:
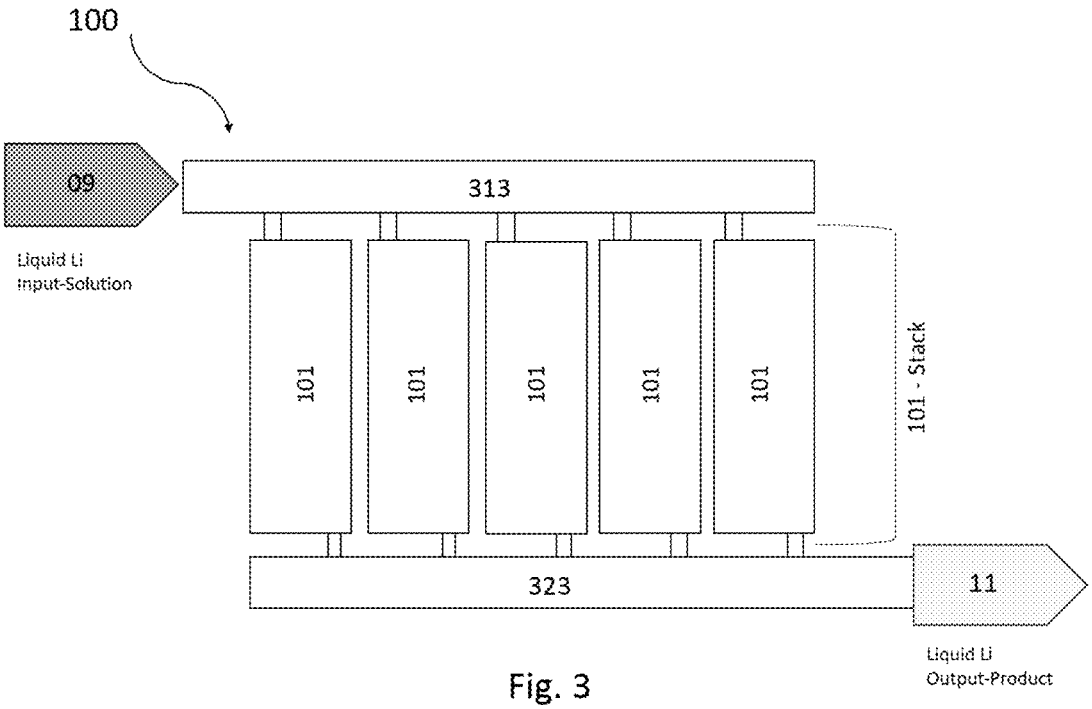
FIG. 3 illustrates a dry Li transfer electrolysis circuit, in accordance with various embodiments of the present disclosure.

As illustrated in FIG. 3. electrolysis unit 100 (also shown in FIG. 1) includes input manifold 313 for receiving, distributing, and flowing liquid Li input solution 09 into and through electrolysis cell stack 101-S, which is composed of a series of dry transfer electrolysis cells 101 communicating with output manifold 323 for receiving, distributing, and flowing liquid Li output product 11 through the stack. In various embodiments input-solution 09 is derived from a natural Li resource such as mineral ores, salars, salt lakes, underground brines (including oilfield and geothermal type), or derived from a waste or recycling stream such as that which is generated in the form of a slurry from spent Li batteries. In various embodiments output-liquid 11 is an intermediary aqueous lithium hydroxide solution or slurry, which may be further processed, by drying, to produce a lithium hydroxide monohydrate substance material, typically in the form of a powder. Such powders are of particular importance because they are the preferred precursor for producing high performing and high-quality cathode materials for use in positive electrodes in Li ion batteries.

Figure 4:
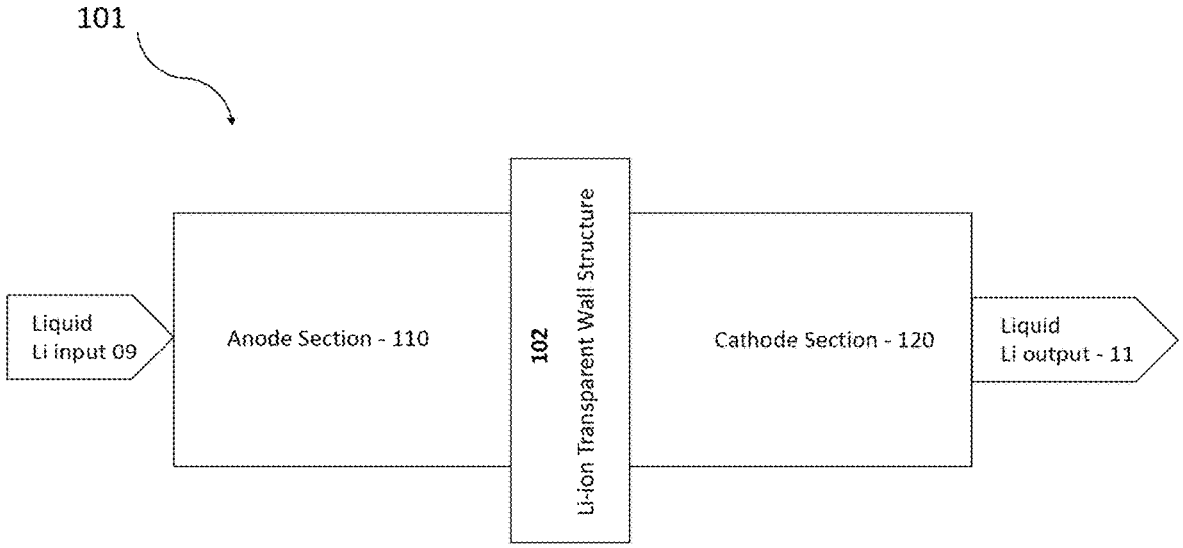
FIG. 4 illustrates a schematic drawing of a dry Li transfer electrolysis cell, in accordance with various embodiments of the present disclosure.

In accordance with various embodiments, dry transfer electrolysis cell 101 is schematically illustrated in FIG. 4. It generally includes anode section 110, cathode section 120 and Li-ion transparent wall structure 102, which, impermeable to liquid molecules of the input/output liquids 09/11, provides the medium for dry transfer of Li ions from the anode section to the cathode section. By dry transfer it is meant that Li ions transfer from the anode to the cathode without the co-migration or co-diffusion of liquid molecules. In accordance with the present disclosure wall structure 102 is preferably highly selective for through transport of Li ions and even more preferably completely blocking of other monovalent cations (e.g., $Na^+$ and $K^+$) and/or other divalent cations (e.g., $Mg^{++}$ and $Ca^{++}$). In various embodiments liquid Li input solution 09 is a chloride solution and the electrochemical redox of the cell involves the following reaction $2LiCl+2H_2O \rightarrow 2LiOH+H_2+Cl_2$ and generation of a lithium hydroxide slurry in the cathode section as the primary product 11.

Figure 5:
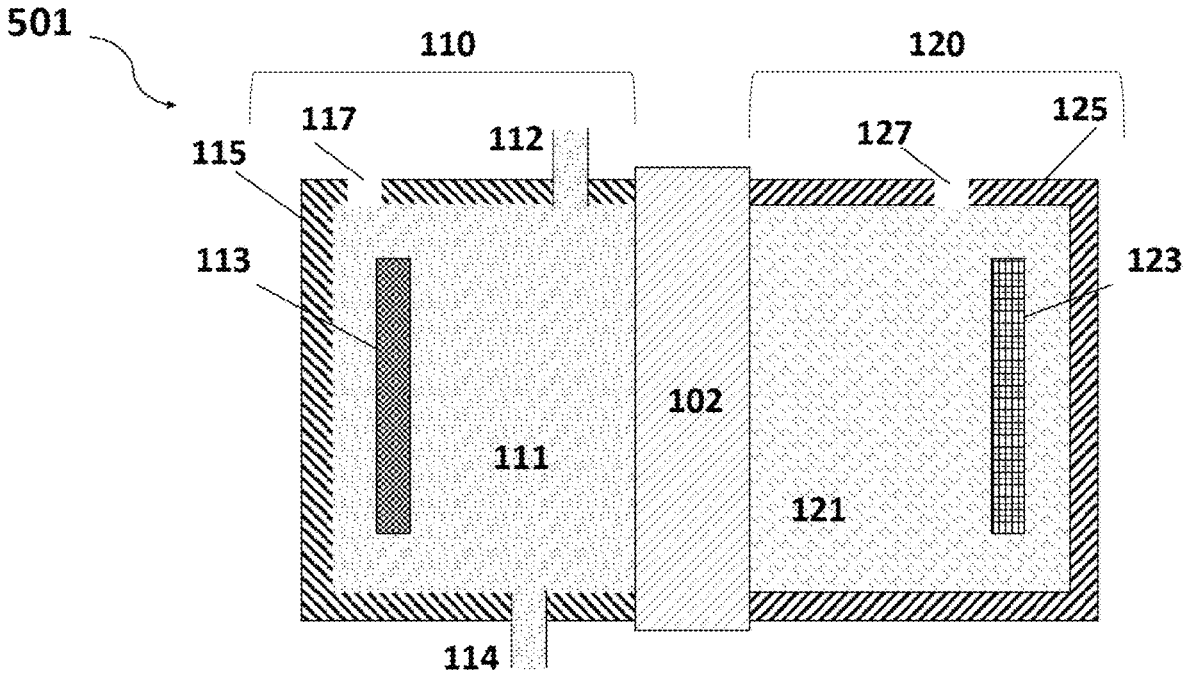
FIG. 5 illustrates a dry Li transfer electrolysis cell, in accordance with various embodiments of the present disclosure.

A more detailed illustration of dry transfer electrolysis cell 501, in accordance with various embodiments of the present disclosure, is illustrated in FIG. 5. Anode section 110 of cell 101 includes liquid anolyte 111, inlet and outlet ports 112/114 (for flowing liquid anolyte 111 into and through the anode section) and anode-electrode 113. In various embodiments cell 101 also includes gas-port 117 for removing gaseous products of the electrochemical oxidation reaction out of the chamber (e.g., $Cl_2$ gas or $O_2$ gas). For instance, $Cl_2$ gas generation may be considered a secondary or tertiary product of the Li extraction process and may be used in upstream or downstream processing circuits (e.g., combined with $H_2$ gas generated at the cathode electrode to form HCl that may be then used in upstream DLE circuit 8 (as shown in FIG. 2) or other washing process. Cathode section 120 includes liquid catholyte 121, inlet and outlet ports 122/124 (for flowing liquid catholyte 121 into and through the cathode section), cathode-electrode 123, and typically also including gas-port 127 for releasing gaseous products that may be generated as a result of the electrochemical reduction reaction taking place at the cathode electrode. Anode-electrode 113 is preferably non-reactive and may be sheet, porous or otherwise, of a non-reactive metal such as platinum or a platinum plated metal such as platinized titanium or graphite, for example. Cathode-electrode 123 may be a titanium, graphite, or other metal such as stainless steel or nickel.

In various embodiments wall structure 102 is a substantially impervious Li ion conducting membrane, preferably a single ion conductor of Li with a Li ion transference number of about 1 (e.g., transference number of 1). By "substantially impervious" it means that the membrane is impervious to liquid molecules that it comes into contact with during operation as a wall structure or wall structure component in a dry transfer electrolysis cell of the present disclosure. In various embodiments wall structure 102 has a single layer construction, composed solely of a Li ion conducting ceramic membrane. Particularly suitable Li ion conducting ceramic membranes for use herein for wall structure 102 include LATP and LLTO. In various embodiments the substantially impervious Li ion conducting ceramic membrane is wholly composed of Li ion conducting ceramic material, such as a dense sintered ceramic. In other embodiments substantially impervious Li-ion conducting ceramic membrane is a composite membrane composed of substantially impervious Li-ion conducting ceramic membrane particles embedded within a binder matrix of a polymer material or glass material or other ceramic material that is generally not Li ion conductive but impervious to liquids of the cathode and/or anode sections that it comes into contact with. A particularly suitable Li-ion conducting ceramic material that may be used as a wholly sintered membrane or as particles in a composite as described above are lithium ion conducting metal phosphates, and especially lithium aluminum titanium phosphates (sometimes referred to as LATP). Other suitable membranes are contemplated including lithium metal oxides such as Li ion conducting lithium titanates (sometimes referred to as LTO). Generally, the input and output liquids are aqueous, and thus an important property of the substantially impervious Li ion conducting membrane (wholly sintered or composite) is that it is chemically compatible with the aqueous liquids it comes into contact with.

In accordance with the present disclosure Li ion conducting wall structure component 102 includes one or more substantially impervious Li ion conducting ceramic membranes that are preferably single Li ion conductors with high selectivity for electrically migrating Li ions relative to other monovalent and divalent cations. By use of the term substantially impervious it is meant that the Li ion conducting ceramic membrane is chemically compatible with, and impervious to, liquid molecules that it operably contacts during the Li extraction process. In various embodiments the substantially impervious Li ion conducting ceramic membrane is a dense sintered sheet (e.g., having a long edge or diameter that is less than 25 cm), and the wall structure is composed of a macro-array of such sintered sheets configured into a wall structure by means of fixing the membrane array using a substantially impervious bonding agent (e.g., the wall structure having a long edge or diameter that is at least 30 cm, and more typically at least 60 cm). Preferably, the wall structure is free of defects through which a modicum of water may seep across and the dense sintered membrane sheets, from which it is manufactured, are pinhole free. In various embodiments the substantially impervious Li ion conducting ceramic material from which the membrane and wall structure are composed is a lithium metal phosphate ceramic Li ion conductor (e.g., such as those commonly referred to has LATP and the like) or a perovskite type oxide Li ion conductor (e.g., such as those commonly referred to has LLTO and the like). For instance, one example of LATP has composition $Li_{1.3}Al_{0.3}Ti_{1.7}(PO_4)_3$, and one example of LLTO is $La_{0.57}Li_{0.29}TiO_3$.

Figure 6:
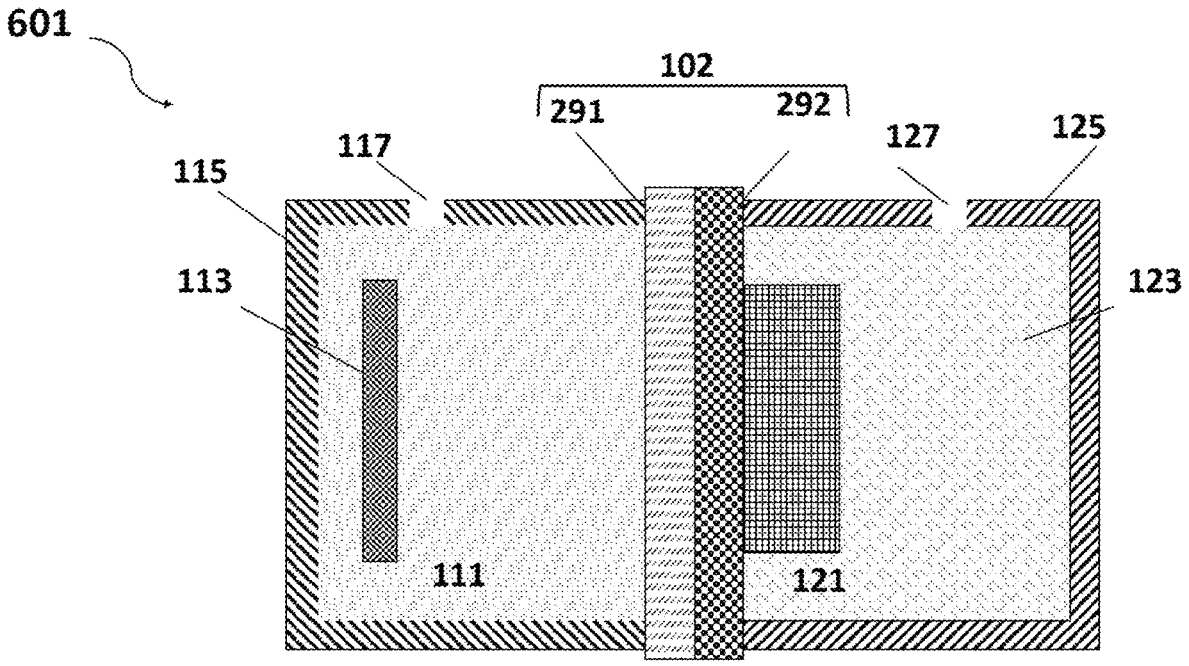
FIG. 6 illustrates a dry Li transfer electrolysis cell, in accordance with various embodiments of the present disclosure.

In other embodiments, wall structure 102 may have a multilayer construction. For instance, as illustrated in cell 601 in FIG. 6, wall structure 102 is a bilayer composed of substantially impervious Li ion conducting ceramic membrane 691 opposing anode section 110 and second layer 692 (e.g., laminated to ceramic membrane 691) that is not substantially impervious but provides benefit in contact with liquid catholyte 121 or more generally liquids of the cathode section. For instance, layer 692 may be a cationic exchange membrane that is substantially blocking of anions and in particular blocking of hydroxyl anions such that it keeps the pH of the liquid in contact with the cathode facing side of the membrane to a value that is different than the pH of the output liquid. For instance, the pH of liquid in contact with the membrane second surface is kept below a pH of 10 and the pH of the output liquid is that of 10 or above.

Figure 7:
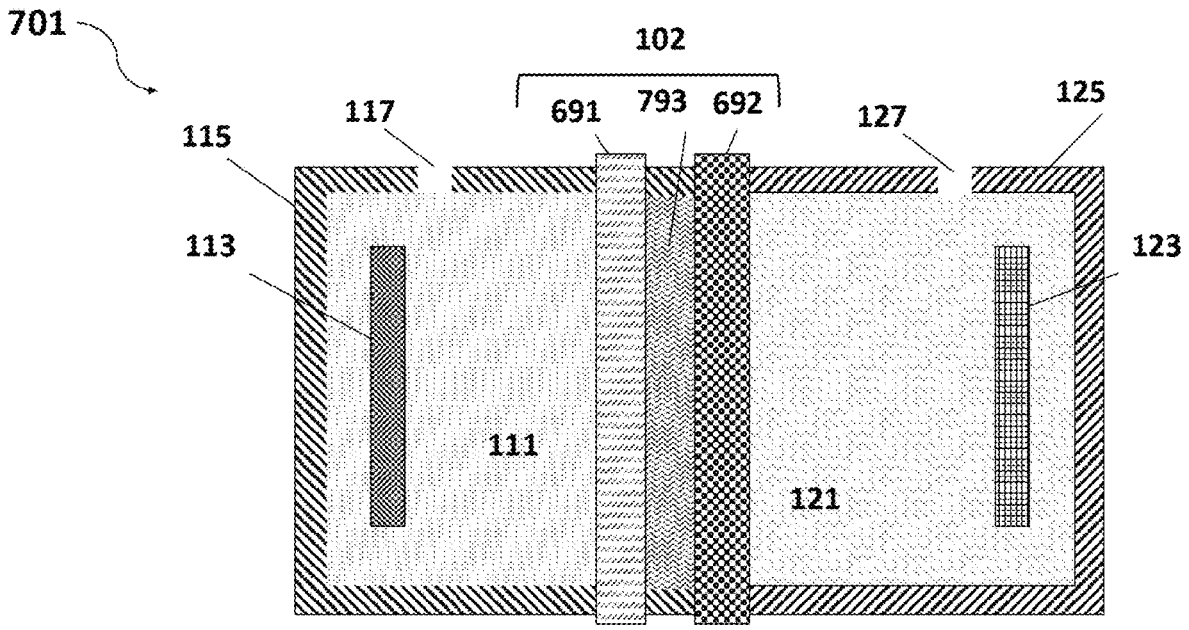
FIG. 7 illustrates a dry Li transfer electrolysis cell, in accordance with various embodiments of the present disclosure.

In another embodiment, illustrated in FIG. 7, electrolysis cell 701 has a wall structure with a multi-channel architecture, wherein membrane 691 and 692 are separated from each other by an interlayer channel 793 which includes a buffer liquid that is optimized for chemical stability in contact with both membranes 691 and 692.

In various embodiments, the electrolysis cell has a flat stacked architecture. However, the disclosure is not limited as such, and tubular construction are contemplated wherein the wall structure is tubular/cylindrically shaped and the anolyte and catholyte liquids are caused to flow through the gaps on either side of the wall structure tube.

In a particular example, the present disclosure provides an electrolysis unit that takes as input liquid a Li brine and produces an output liquid of lithium hydroxide slurry as the primary product, while generating chlorine gas and hydrogen gas as secondary and tertiary products of the electrolysis step.

CONCLUSION

Although the foregoing disclosure has been described in some detail for purposes of clarity of understanding, it will be apparent that certain changes and modifications may be practiced within the scope of the disclosure. It should be noted that there are many alternative ways of implementing both the process and apparatuses of the present disclosure. Accordingly, the present embodiments are to be considered as illustrative and not restrictive, and the disclosure is not to be limited to the details given herein.

All references cited herein are incorporated by reference for all purposes.

What is claimed:

1. A method for Li extraction, comprising:

a dry transfer electrolysis process for extracting, enriching, purifying and/or producing an aqueous Li substance as a primary product from a liquid Li input solution that is derived from a Li resource, wherein the process comprises operation of an electrochemical cell having a wall structure separating an anode section and a cathode section, wherein the wall structure comprises: (i) a substantially impervious lithium-ion conducting ceramic membrane; and (ii) a second layer laminated to the ceramic membrane and comprising a cation exchange membrane, wherein the cation exchange membrane is configured to inhibit transport of hydroxyl ions toward the ceramic membrane such that a pH at a surface of the ceramic membrane facing the cathode section is maintained lower than a pH of a bulk cathode solution in the cathode section.

2. The method of claim 1, wherein the Li resource is a geothermal or oilfield brine.

3. The method of claim 1, wherein the Li resource is selected from the group consisting of a natural or synthetic Li brine, a Li containing ore, or spent Li batteries processed into a Li containing slurry.

4. The method of claim 1, wherein the liquid Li input solution undergoes a dry Li transfer electrolysis process that generates an aqueous lithium hydroxide slurry as a primary intermediate product.

5. The method of claim 4, wherein the primary intermediate product is further processed into a high purity lithium hydroxide monohydrate powder.

6. The method of claim 5, wherein the lithium hydroxide monohydrate powder is devoid of any measurable amount of contaminating monovalent and divalent cations.

7. A Li extraction plant for extracting lithium from a lithium containing resource, the plant comprising:

a dry transfer Li electrolysis unit staged within the plant among other upstream and/or downstream units;

wherein the dry transfer Li electrolysis unit comprises an electrochemical cell having a wall structure separating an anode section and a cathode section, wherein the wall structure comprises:

(i) a substantially impervious lithium-ion conducting ceramic membrane; and (ii) a second layer laminated to the ceramic membrane and comprising a cation exchange membrane.

8. The Li extraction plant of claim 7, wherein, in operation, the lithium containing resource comprises mineral ores, brines, or spent batteries.

9. The Li extraction plant of claim 7, wherein the other upstream and/or downstream units comprise a solid particulate filtration circuit positioned upstream of the dry transfer Li electrolysis unit and a drying/evaporating circuit positioned downstream of said electrolysis unit.

10. A dry transfer Li electrolysis circuit, comprising:

a dry transfer Li electrolysis unit configured for dry transferring Li ions from an aqueous Li input solution to an aqueous Li output solution;

wherein the dry transfer Li electrolysis unit comprises an electrochemical cell having a wall structure separating an anode section and a cathode section, wherein the wall structure comprises:

(i) a substantially impervious lithium-ion conducting ceramic membrane; and (ii) a second layer laminated to the ceramic membrane and comprising a cation exchange membrane, wherein the cation exchange membrane is configured to inhibit transport of hydroxyl ions toward the ceramic membrane such that a pH at a surface of the ceramic membrane facing the cathode section is maintained lower than a pH of a bulk cathode solution in the cathode section.

11. The dry transfer electrolysis circuit of claim 10, wherein the dry transfer electrolysis unit includes one or more dry transfer electrolysis cells wherein Li ions are dry transferred from an anode section configured to receive the aqueous Li input solution, to a cathode section wherein the aqueous Li output solution is generated.

12. The dry transfer electrolysis circuit of claim 10, wherein the aqueous Li input solution is derived from a lithium containing resource comprising mineral ores, brines, or spent batteries and the aqueous Li output solution is an aqueous lithium hydroxide slurry.

13. The dry transfer electrolysis circuit of claim 10, wherein the dry transfer electrolysis unit transfers Li ions from the anode section to the cathode section without the co-migration or co-diffusion of liquid molecules.

14. The dry transfer electrolysis circuit of claim 11, wherein the one or more dry transfer electrolysis cells comprise an anode-electrode and a cathode-electrode disposed in an anode chamber and cathode chamber respectively, wherein the anode chamber and the cathode chamber are partitioned by a Li ion conducting wall structure component, whereby, in operation, dry Li ion transfer occurs without co-migration and diffusion of water molecules therethrough.

15. The method of claim 1, wherein the cation exchange membrane is disposed on a side of the ceramic membrane facing the cathode section.

16. The method of claim 1, wherein the cation exchange membrane is substantially blocking of anions.

17. The method of claim 16, wherein the anions comprise hydroxyl ions.

18. The method of claim 1, wherein the cation exchange membrane maintains a pH of liquid in contact with the ceramic membrane below a pH of an output liquid.

19. The method of claim 1, wherein the pH of liquid in contact with the ceramic membrane is below 10 and the pH of the output liquid is 10 or greater.

20. The method of claim 1, wherein the cation exchange membrane is not substantially impervious to liquid.

* * * * *